US007486271B2

(12) United States Patent
Hershkovitz et al.

(10) Patent No.: US 7,486,271 B2
(45) Date of Patent: Feb. 3, 2009

(54) SECURITY SYSTEM USER INTERFACE WITH VIDEO DISPLAY

(76) Inventors: Shmuel Hershkovitz, 53 Fortune Bay Inlet, Freeport (BS); James Anglehart, 4532, avenue Old Orchard, Montréal, Québec (CA) H4A 3B7

( * ) Notice: Subject to any disclaimer, the term of this patent is extended or adjusted under 35 U.S.C. 154(b) by 677 days.

(21) Appl. No.: 10/793,326

(22) Filed: Mar. 5, 2004

(65) Prior Publication Data

US 2004/0257336 A1 Dec. 23, 2004

Related U.S. Application Data

(63) Continuation-in-part of application No. 10/378,656, filed on Mar. 5, 2003, now Pat. No. 7,046,142.

(51) Int. Cl.
*G09G 5/00* (2006.01)

(52) U.S. Cl. ..... 345/156; 345/168

(58) Field of Classification Search ..... 340/506, 340/531, 539.25, 541, 524, 525, 539.1, 545.5; 709/220; 348/143, 423, 152, 153; 345/156–173; 379/37, 106.01

See application file for complete search history.

(56) References Cited

U.S. PATENT DOCUMENTS

| | | | | |
|---|---|---|---|---|
| 6,069,653 | A * | 5/2000 | Hudson | 348/143 |
| 6,714,236 | B1 * | 3/2004 | Wada et al. | 348/152 |
| 6,975,220 | B1 * | 12/2005 | Foodman et al. | 340/531 |
| 7,046,142 | B2 * | 5/2006 | Hershkovitz et al. | 340/541 |
| 2002/0005894 | A1 * | 1/2002 | Foodman et al. | 348/143 |
| 2002/0067259 | A1 * | 6/2002 | Fufidio et al. | 340/541 |
| 2004/0022377 | A1 * | 2/2004 | Elberbaum | 379/106.01 |
| 2004/0215750 | A1 * | 10/2004 | Stilp | 709/220 |
| 2006/0009863 | A1 * | 1/2006 | Lingemann | 700/19 |
| 2006/0220830 | A1 * | 10/2006 | Bennett et al. | 340/506 |

* cited by examiner

*Primary Examiner*—Nitin Patel
(74) *Attorney, Agent, or Firm*—Ogilvy Renault, LLP

(57) ABSTRACT

A security system user interface comprising a graphical display, a communication link, a memory, a camera and a display controller. The camera image is converted for display on the graphical display, the latter being used for security system control and viewing the camera image. The interface is best located near an entrance inside a secured premises, while the camera is arranged to monitor visitors outside the secured premises at the entrance. The camera can be connected directly to the user interface or indirectly using a data communications link of the security system interconnecting security detectors to a control panel.

27 Claims, 3 Drawing Sheets

SECURITY SYSTEM USER INTERFACE WITH VIDEO DISPLAY

CROSS-REFERENCE TO RELATED APPLICATIONS

This application is a continuation-in-part of U.S. patent application Ser. No. 10/378,656, filed Mar. 5, 2003, now U.S. Pat. No. 7,046,142, the specification of which is hereby incorporated by reference.

FIELD OF THE INVENTION

The present invention relates to the field of method and devices for interfacing with security systems assuring protection of buildings or other types of premises or locations.

BACKGROUND OF THE INVENTION

Home and commercial security systems conventionally have a central control panel connected to a number of security detectors. The control panel typically has a keypad for entering a security code used for authenticating authorized users for arming and disarming the system, and also for programming security options. The security detectors typically include motion detectors, such as passive IR motion detectors or microwave motion detectors, whose object is to detect people moving within a zone or area of a building. Detectors are also used to detect door and window open/closed states, and sharp sounds such as glass breaking. The control panel interprets detector signals in accordance with the programmed armed/disarmed state for the zones to determine if an alarm should be generated. Most control panels are connected by telecommunications links to police or an alarm service.

In applicant's co-pending application, there is described a graphical user interface for a security system control panel. Such a graphical user interface can be used advantageously to view a floor plan of a building to visualize more easily the armed/disarmed zones, and to make programming of the control panel more user friendly by the advantages of a graphical user interface.

Security cameras are typically used in two contexts: security monitoring (either live monitoring by a security guard, or recorded surveillance for review by police after a crime has been committed) and entrance security in which an occupant calling interface (i.e. a general doorbell switch or an interface for "buzzing" one of a number of occupants) is provided at an entrance along with a camera for viewing the visitor. The occupant is provided with a display to view the visitor prior to deciding to admit the visitor to the building.

Entrance security systems are stand-alone systems separate from home and commercial security systems. In the case of home security systems, the doorbell switch and doorbell, and possibly an entrance intercom, is purchased and installed in the home separately from any security system.

SUMMARY OF THE INVENTION

It is an object of the invention to provide a security system control panel that provides the function of entrance camera security.

It is an object of the invention to provide a security system control panel that uses a graphical user interface display of the control panel for displaying video images from an entrance security camera.

It is an object of the invention to provide a security system control panel that provides the function of a doorbell.

It is an object of the invention to provide a security system control panel that provides the function of entrance security with recording of entrance security events, such as times of occupant calling interface activity and/or images from an entrance monitoring camera.

It is an object of the invention to allow data from an entrance security camera and/or occupant calling interface to be carried over a local communications link of a security system used to carry security detector signals from detectors to a control panel.

It is an object of the invention to provide a security system control panel that is located inside secure premises near an entrance and is coupled to a video display for displaying video images from an entrance security camera to determine if a visitor is to be admitted and for allowing convenient timely response to let in the visitor.

In accordance with an embodiment, there is provided a security system comprising: a plurality of security detectors located within protected premises; a control panel having a display device; a local communications link for carrying a security detector status signal between each one of the security detectors and the control panel: and a camera located in a vicinity of the protected premises, for transmitting an image via the local communications link carrying the security detector status signal, for display at the control panel by the display device.

In accordance with another embodiment, there is provided a security system comprising: a plurality of security detectors located within protected premises; a control panel; a local communications link for carrying a security detector status signal between each one of the security detectors and the control panel; an occupant calling interface for sending user input data over the local communications link, to the control panel; and a door bell unit located at an entrance of the protected premises and coupled to the local communications link, the door bell unit being controlled by the control panel in accordance with the user input data.

In accordance with another embodiment, there is provided a security system comprising: a local communications link; a plurality of security detectors located within protected premises, each coupled to the local communications link; a control panel for receiving a security detector status signal from one of the security detectors, the security detector status signal being carried over the local communications link; a display device coupled to said control panel, to display information about one of an operational state and a programming state of said security detectors, as provided by said security detector status signal; and a camera coupled to said control panel, for acquiring an image to be transmitted to said control panel via the local communications link, the control panel forwarding the image to said display device.

BRIEF DESCRIPTION OF THE DRAWINGS

The invention will be better understood by way of the following detailed description of a preferred embodiment with reference to the appended drawings, in which.

DETAILED DESCRIPTION OF THE INVENTION

The following is a description of a specific preferred embodiment of the invention that will serve to improve understanding of one way in the invention may be put into practice. It will be appreciated that many other ways of implementing the invention are possible.

Figure 1:
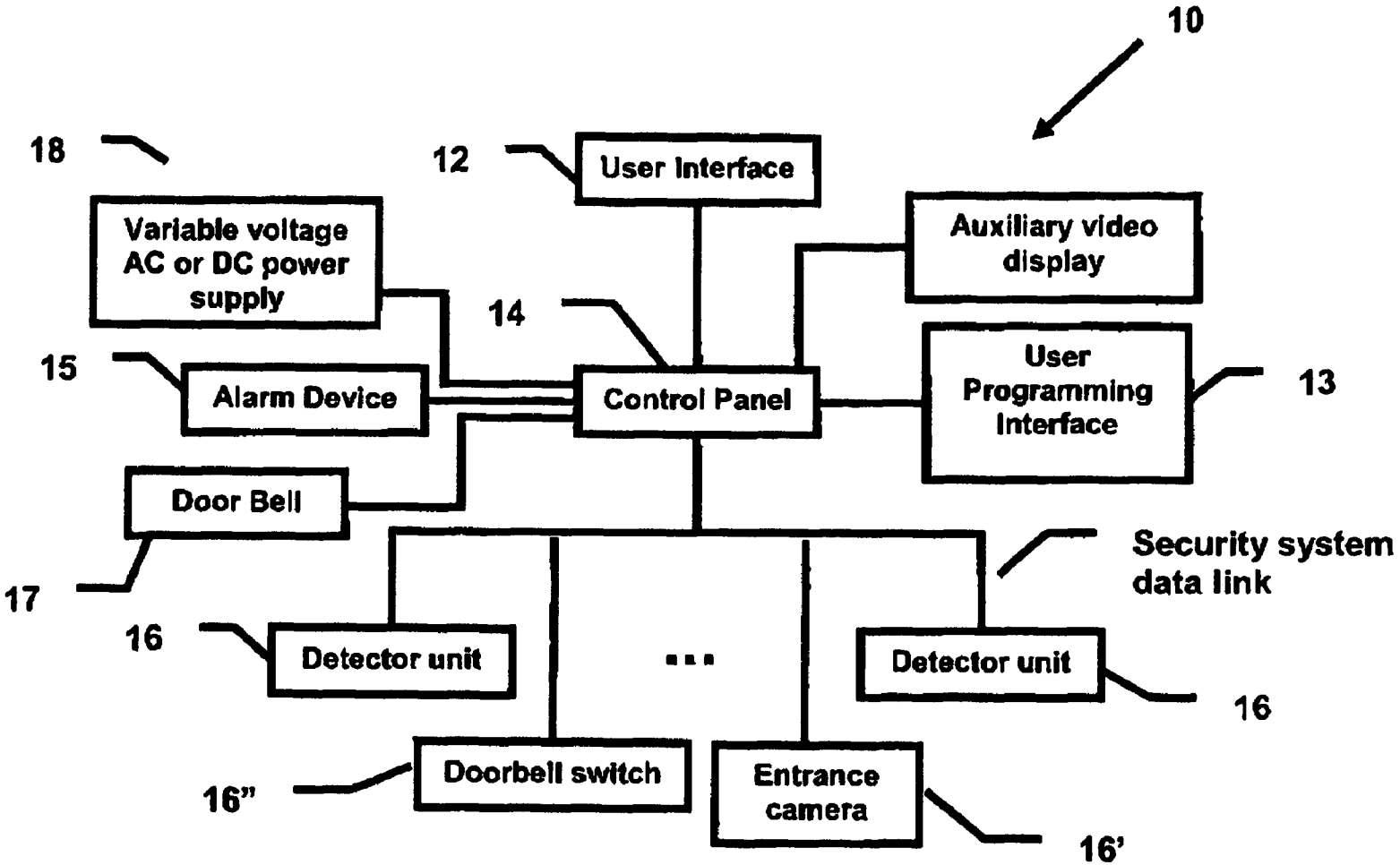
FIG. 1 is a block diagram showing a security system protecting a premise having a doorbell switch, door bell and entrance monitoring camera using the security system data link to interconnect the entrance security system components.
Figure 2:
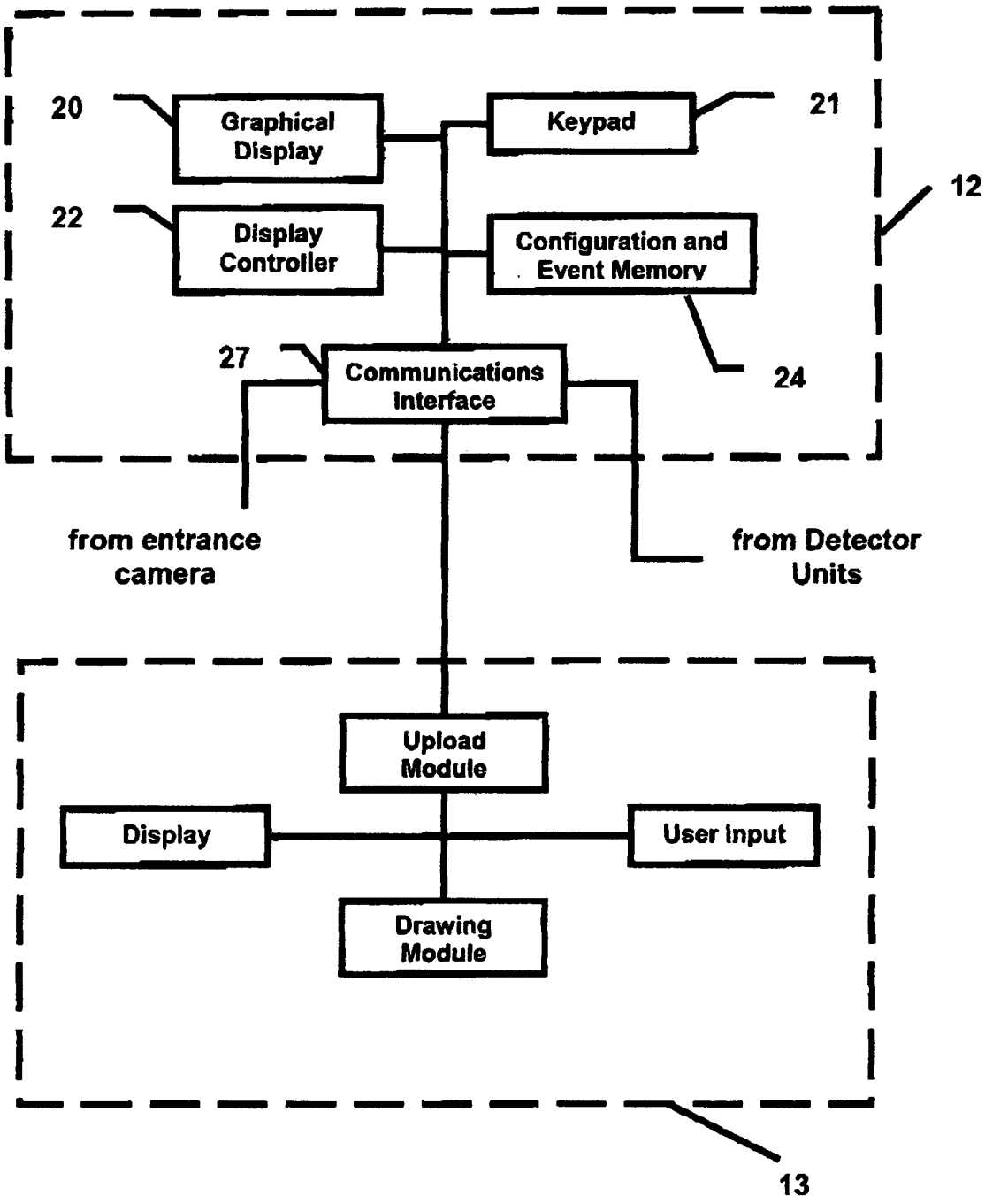
FIG. 2 is a block diagram showing a security system user interface and a user programming interface in accordance with an embodiment of the invention.

In the preferred embodiment, as illustrated in FIG. 1, the security system control panel 14 is located separately from a wall mounted a user interface device 12 that is equipped with an LCD display screen 20 (see FIG. 2) primarily used for programming and control functions of the security system. The graphical display 20 is used to provide a user GUI interface with a representation of a floor plan of the protected premises including locations as well as the individual status of the security detectors graphically shown. Display 20 is a touch screen of small dimensions so as to be discreet when wall mounted. Given the limitations and comfort level when using a small touch screen as a programming interface for specifying a floor plan and placing the detectors therein, an external programming interface 13, such as a laptop computer provided with suitable software, may be used.

Figure 3:
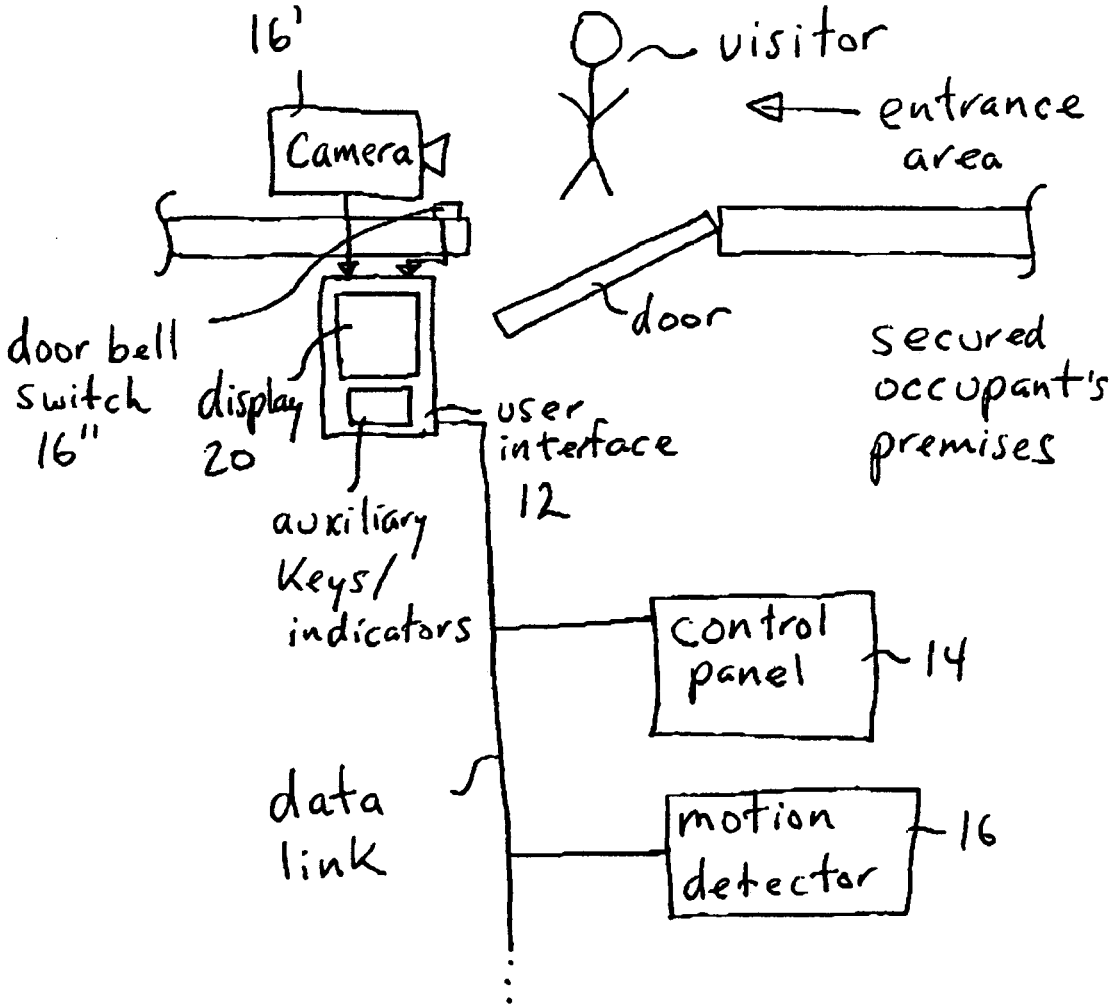
FIG. 3 is a plan view of an entrance equipped with a security camera and a door bell switch with a security system control panel having a video display located near the entrance in accordance with an embodiment of the invention.

The user interface 12 is located near the entrance, as illustrated in FIG. 3. A closed circuit video camera 16' can be a "webcam" device that outputs still or motion video on a convention data link, such as USB or IEEE1394, or a video camera providing a standard video display signal, such as NTSC, PAL or HDTV. Camera 16' and doorbell switch 16" are connected directly to the user interface 12 by separate cables. It will be appreciated that the connection could alternatively be to the control panel 14, and the camera image could be transmitted to display 12 from the control panel 14. As these devices and thus their associated cables can be accessed from outside the secured premises, appropriate isolation between the devices and the panel is provided to prevent tampering with the cables or devices from damaging the user interface or control panel circuitry. Suitable isolation will be apparent to a person skilled in the art. As illustrated, the camera image is converter to the resolution and format suitable for display on the LCD screen display 20 by display controller 22 (shown in FIG. 2).

In the preferred embodiment, an occupant answering a door bell will go to the security control user interface 12 located near the entrance to see an image of the visitor prior to deciding whether to open the door. The system 10 is provided with a user input control to begin viewing the camera image (either as a still image or as motion video), however, the control panel 14 responds to the door bell switch signal by automatically switch to displaying on the screen 20 the video image. The control panel 14 also records the time that the door bell switch 16" was pressed and a still image from the video camera at the time that the switch 16" is pressed. While it is possible to store more video information than a single image each time a visitor rings the door bell, it will be appreciated that video data consumes considerable memory.

In the preferred embodiment, the occupant calling interface is simply a push-button, wall-mounted, door bell switch associated with a single occupant. It will be appreciated that for apartments and multi-tenant buildings, the interface is more complex and allows selection of one of many occupants, as is known in the art.

A log of the door bell switch activities and camera images is stored in non-volatile memory associated with the control panel 14, such as the configuration memory 24 in the interface 12. From the interface 12, the occupant can review the log as desired. The interface 12 can also display a message that new items have been added to the log since its last access by the occupant. The images stored in memory may have a resolution and color format that is different (and of better quality) than the display. Such stored images may be exported via interface 13 to be reviewed using a computer having imaging software and a display able to provide better viewing and analysis of the images.

Given that the user interface is equipped with an LCD touch screen 20 used for GUI-based programming of the security system and having a relatively poor resolution (namely either as a result of its size or its pixel density, the total number of pixels displayed is low), the control panel is configured to zoom the higher resolution camera image at the position on the screen that the user touches to provide a digital zoom, for example 2× to 4×. In this way, the camera has a relatively wide field of view covering an exterior entrance area, and independent of the visitor's chosen position (vertically and/or horizontally) within the entrance area the user will be able to identify more clearly the visitor without needing a navigable camera or a higher resolution display. Thus, the user will typically touch the screen 20 at the position where the face of visitor appears in the non-zoomed image, and the zoomed image will appear on the screen with that position being in the middle of the image. The zoom feature can be caused to change among a plurality of magnifications, for example, from 1× to 4× to 9× in a cyclical manner with each touch of the screen 20. While the mentioned multiples avoid the need to perform pixel interpolation for generating the zoom images, any desired zoom factor may be used. The image shown on display 20 is adjusted automatically for brightness and contrast, and this adjustment is performed for the portion of the camera image shown on the screen without consideration of the remainder of the camera image in the case of zoom images. This may allow a visitor to be clearly seen against a bright sunlit background.

The size of the screen 20 incorporated into the user interface 12 is about 25 $cm^2$ to 50 $cm^2$. The LCD screen 20 in the preferred embodiment is monochrome, namely black and white. While the display 20 preferably has circuit level gray scale, it may be pure black and white, namely one that offers no circuit level gray scale. In the latter case, the camera image is transformed to simulate gray by grouping pixels to represent shades of gray in areas of the same brightness, with anti-aliasing being applied to reduce artifacts at the boundaries between such areas. Such techniques are known in the art, as for example in facsimile transmission of photographic images. When the resolution of the camera image and that of the display are not the same (as in the preferred embodiment), the display controller 22 (or alternatively an image processor in control panel 14) performs the necessary scaling with pixel interpolation. In the case of a monochrome display, the color conversion is also performed in the display controller 22 (or alternatively an image processor in control panel 14).

Camera controls are also provided from user interface 12. Settings controlling camera image brightness, contrast, color (in the case of a color camera), and video frame rate for display are input and viewed using the graphical interface 12. The automatic control settings regarding trigger of camera operation, zoom options and image storage in memory are also set using the user interface 12.

The doorbell unit 17 is a conventional electric doorbell (i.e. bell, chime or buzzer). Such devices are often powered by 8V to 24V AC provided by a step-down transformer connected to the AC mains, although electronic doorbells may be powered by 3V to 12V DC. The control panel uses an electronic power switching circuit 18 to deliver the desired AC or DC voltage necessary to drive the doorbell 17. Circuit 18 is connected to the power mains and provides an output with the AC or DC voltage selected according to an input control signal. The installer sets the desired voltage value and AC or DC setting from the graphical user interface (or by using DIP switches on the panel's board), and connects the wires leading to doorbell 17 to the connector strip on the panel 14.

While in the preferred embodiment, it is desired to allow any standard doorbell to be connected to panel 14, device 18 may be removed if a low voltage (i.e. less than or equal to the battery voltage) doorbell unit 17 is used. Alternatively, the existing control panel audio output and/or alarm device 15 may be used to provide door buzzer or chime sound.

Also advantageously, if the control panel is connected to a telephone line so as to report an alarm (the alarm device 15 can be a telephone line coupler and modem or other signal transmitter, or any suitable telecommunications interface, in additional to a local audio alarm or siren), various ways may be used to provide the door bell via existing residential telephones (i.e. regular PSTN, and no PBX). This is suitable if the line is used exclusively for voice, and never for fax or modem communications. The control panel 14 would then detect if the telephone line is in use. If so, the control panel would then emit a tone to be heard within the customer premises equipment. If the line is not in use, and the telephone service provider permits such action, a ring signal is output to the ring and tip wires to which the control panel is connected. This would cause all telephones at the customer premises to ring, preferably with a distinctive ring associated with the doorbell. Alternatively, the control panel may be of the type that is connected to the telephone line at the entry of the line from the central office with the control panel being equipped with a relay to control the connection of subscriber equipment within the customer premises. Such an arrangement is desirable so that the control panel may cut off any current use of the telephone line and use the line to report an alarm. When the door bell switch 16" is activated, and the telephone line is not in use, a brief cut-off of the external telephone line using the relay could be done while a ring signal is provided to the customer premises subscriber equipment (namely the other side of the relay) without sending any signal to the central office. Circuitry able to provide an alert signal on an occupant telephone line in response to input from an occupant calling interface is well known in the art for apartment building entry control systems.

It will be appreciated that the door bell switch 16" is not directly connected to the door bell unit 17. The control panel 14 is thus able to control operation of the door bell. For example, in one operation mode selected using the user programming interface 13, the door bell unit may be muted so as not to disturb the occupants. Such a mute function may be set according to a preprogrammed time of day schedule, or manually switched on or off. Door bell ring volume, ring or chime type and/or duration may likewise be programmed.

In the preferred embodiment, the door bell switch 16", the door bell unit 17 and the camera 16' are directly connected via separate connectors to the user interface 12. This is convenient when the user interface 12 is physically located near the entrance. However, many recent models of control panels use wired communications buses or other physical links that are shared among a network of detectors and devices, or alternatively wireless communications between devices and the control panel. Such security system control panels reduce significantly the time required to install a security system, either by reducing the amount of wiring to be installed, or by eliminating such wiring altogether. Thus, in a second embodiment of the invention, the switch 16" and the camera 16' are connected to the security system data link as illustrated in FIG. 1. While this embodiment requires that each of the devices 16', and 16" be provided with suitable interface circuitry, installation is made much easier. Alternatively, each device is provided with a wireless interface, and the data link illustrated in FIG. 1 is implemented by wireless means. It will be appreciated that the doorbell unit 17 could also be connected to the link, as long as it is provided with its own power supply and link interface.

It will also be appreciated that the user programming interface 13 can include a floor plan display showing a layout of detectors within the protected premises. The camera 16' and door bell switch 16" devices can likewise be included in such a layout display.

While in the preferred embodiment, the user interface 12 equipped with a video display is located near the entrance, in an alternative embodiment, a display device is provided that is separate from the user interface 12. Such a display device is connected to the data link to which the camera is connected. This allows the display to be located near the entrance or at any location of convenience within the occupant's premises. The user interface and/or the control panel then serve to control the display of images and to record the log information.

While in the preferred embodiment, the camera is arranged to view or monitor an entrance to the premises, it is of course desirable to view or monitor areas within the protected premises. For example, a camera may be installed in an infant's or child's room in the home.

It will be appreciated that when a camera is arranged with a motion detector, the invention allows for images to be captured around the time that the motion detector detects motion. Such images can be stored in a log. If such motion causes an alarm, the image can be displayed on display 20, preferably when the occupant reaches the user interface to disable the alarm. When the occupant fails to disable the alarm and an alarm signal is transmitted to a remote monitor, the camera image may also be provided to the remote monitor.

While in the preferred embodiment, the invention provides door bell functionality in addition to entrance security camera functionality, it will be appreciated that the invention may be used to provide only one of door bell functionality and entrance security camera functionality.

Although some preferred implementations of various methods and arrangements have been illustrated in the accompanying drawings and described in the foregoing description, it will be understood that the invention is not limited to the exemplary implementations disclosed, but is capable of numerous rearrangements, modifications and substitutions as set forth and defined by the following claims.

The invention claimed is:

1. A security system comprising:

a plurality of security detectors located within protected premises;

a control panel having a display device;

a local communications link for carrying a security detector status signal between each one of the security detectors and the control panel; and a camera located in a vicinity of the protected premises, for transmitting an image via the local communications link carrying the security detector status signal, for display at the control panel by the display device.

2. The security system as claimed in claim 1, wherein said display device comprises a touch screen for inputting operational state or programming state data.

3. The security system as claimed in claim 2, wherein said display device has a lower resolution that said camera, and wherein said display device comprises a display controller to provides a controllable zoom of said image at a location corresponding to a screen touch.

4. The security system as claimed in claim 1, wherein said display device comprises an LCD display.

5. The security system as claimed in claim 3, wherein said controllable zoom changes in magnification according to a cyclical manner from 1 times to 3 times to 9 times in response to the screen touch.

6. The magnification as claimed in claim 1, wherein said display device has a lower resolution than said camera, and said display controller provides the controllable zoom of said image in response to user input.

7. The security system as claimed in claim 1, further comprising a memory for storing said image, and said display device being adapted to respond to the user input to retrieve and display said image.

8. The security system as claimed in claim 1, wherein said display device comprises a display controller for automatically adjusting said image for brightness.

9. The security system as claimed in claim 1, wherein said image is repeatedly displayed to provide motion video.

10. The security system as claimed in claim 1, wherein said camera is located to view a visitor at an entrance to said protected premises.

11. The security system as claimed in claim 10, further comprising:

an occupant calling interface located at said entrance and coupled to said local communications link to communicate with said control panel, and for receiving a user input; and a door bell unit connected to said data network.

12. The security system as claimed in claim 10, further comprising a memory device for storing said image once received at said control panel, the control panel responding to the user input received by said occupant calling interface, to retrieve and display said image stored.

13. The security system as claimed in claim 12, wherein a time of activation of said occupant calling interface is also stored in said memory device.

14. The security system as claimed in claim 1, wherein said local communications link is wireless.

15. The security system as claimed in claim 1, wherein the security detectors comprise at least one of: a motion detectors, door or window detectors, and sound detectors.

16. A security system comprising:

a plurality of security detectors located within protected premises;

a control panel;

a local communications link for carrying a security detector status signal between each one of the security detectors and the control panel;

an occupant calling interface for sending user input data over the local communications link, to the control panel; and a door bell unit located at an entrance of the protected premises and coupled to the local communications link, the door bell unit being controlled by the control panel in accordance with the user input data.

17. The security system as claimed in claim 16, further comprising a variable voltage power supply for driving said door bell unit, said door bell unit comprising a conventional domestic door bell or chime device, and wherein an output voltage of said power supply being selectable using said control panel.

18. The security system as claimed in claim 16, wherein said control panel comprises a telephone line coupler, said security system using said telephone line to report security alarms, further comprising circuitry for creating a ring signal on a telephone line of said protected premises connected to said control panel.

19. The security system as claimed in claim 16, further comprising an audio alarm device connected to said control panel for generating an audio signal to be clearly heard within said protected premises in case of an alert or alarm condition, said control panel causing said audio alarm device to generate a predetermined door bell sound in response to input from said occupant calling interface.

20. The security system as claimed in claim 16, wherein said occupant calling interface comprises a door bell push button switch.

21. The security system as claimed in claim 16, further comprising a user interface connected to said control panel for programming said state of said security detectors, said user interface being adapted to allow programming of a door bell program defining how said control panel controls said door bell unit in accordance with input received from said occupant calling interface.

22. The security system as claimed in claim 21, wherein said program comprises a time schedule.

23. The security system as claimed in claim 16, further comprising a memory for storing time indications of when the occupant calling interface is activated, and a user interface for displaying a log of said time indications.

24. A security system comprising:

a local communications link;

a plurality of security detectors located within protected premises, each coupled to the local communications link;

a control panel for receiving a security detector status signal from one of the security detectors, the security detector status signal being carried over the local communications link;

a display device coupled to said control panel, to display information about one of an operational state and a programming state of said security detectors, as provided by said security detector status signal; and a camera coupled to said control panel, for acquiring an image to be transmitted to said control panel via the local communications link, the control panel forwarding the image to said display device.

25. The security system as claimed in claim 24, wherein said display device is integrated into a user interface of said control panel.

26. The security system as claimed in claim 24, wherein said camera is located to view a visitor at an entrance to said protected premises.

27. The security system as claimed in claim 26, further comprising a plurality of cameras each transmitting one of a plurality of images on said local communications link, the display device having access to the local communications link for displaying one of the plurality of images from one of said cameras.

* * * * *